US006338198B1

(12) United States Patent
Rolls

(10) Patent No.: US 6,338,198 B1
(45) Date of Patent: Jan. 15, 2002

(54) PENCIL SHARPENER

(76) Inventor: Lewis M. Rolls, 3703 19th St., E., Bradenton, FL (US) 34208

( * ) Notice: Subject to any disclaimer, the term of this patent is extended or adjusted under 35 U.S.C. 154(b) by 0 days.

(21) Appl. No.: 09/632,468

(22) Filed: Aug. 4, 2000

Related U.S. Application Data

(60) Provisional application No. 60/147,429, filed on Aug. 5, 1999.

(51) Int. Cl.[7] ..... B43L 23/00
(52) U.S. Cl. ..... 30/452; 30/453
(58) Field of Search ..... 30/452, 453, 451, 30/462; 7/160

(56) References Cited

U.S. PATENT DOCUMENTS 2,642,044 A * 6/1953 Mussguller ..... 30/452
3,548,691 A * 12/1970 Horrocks ..... 30/452 X
5,077,903 A * 1/1992 Kreim ..... 30/453 X
5,167,071 A * 12/1992 Eisen ..... 30/452

FOREIGN PATENT DOCUMENTS

GB 979927 * 1/1965 ..... 30/452

* cited by examiner

*Primary Examiner*—Douglas D. Watts
(74) *Attorney, Agent, or Firm*—Gifford, Krass, Groh, Sprinkle, Anderson & Citkowski, P.C.

(57) ABSTRACT

A pencil sharpener for sharpening carpenters pencils of the type having a generally rectangular cross-section by squeezing a base member and cover member relative to each other repeatedly while the pencil is positioned in one of two openings in the wall of the sharpener to bring cutting blades into cutting engagement with opposed edges of the pencil. One of the openings serves for sharpening opposed walls of the wide portion of the pencil and the other of the openings serves to position the pencil for sharpening the opposed walls of the narrow portion of the pencil.

18 Claims, 2 Drawing Sheets

PENCIL SHARPENER

This application claims the benefit of U.S. Provisional Application Serial No. 60/147,429 filed on Aug. 5, 1999.

FIELD OF THE INVENTION

This invention relates to pencil sharpeners and more particularly to pencil sharpeners adapted to sharpen carpenter or construction pencils having a rectilinear cross-section.

BACKGROUND OF THE INVENTION

The commonly known carpenter or construction pencil is characterized as being rectangular in cross-section with a width that is almost twice that of its thickness. Such pencils are constructed of a wood covering and a graphite core or lead. The core also has a generally rectangular or oblong cross-section.

The carpenter or construction pencil is used by carpenters and construction workers and also artists and others. However, such pencils have problem with respect to sharpening. Since almost all pencil sharpeners accept only pencils having a generally round cross-section, such sharpeners cannot be effectively used with construction or carpenters pencils. With pencils having around cross-section sharpening is attained by rotary sharpeners, which revolve about a stationary pencil or with stationary blades, which cut or peel a point on a rotating pencil. None of these offer a practical possibility for sharpening carpenter pencils. As a result, the typical method of sharpening carpenters' pencils is to use a penknife or the like to whittle a rough point or to use sand paper to abrade a point.

Pencil sharpeners for carpenters' pencils have been provided but such sharpeners rely on rotating cutters. Such sharpeners typically are large and cumbersome and require a stationary mounting to be effective. There is a need for a pencil sharpener for carpenter pencils, which is readily available to a user operating in the field. Preferably such a sharpener not only should be readily available but also if possible, easily carried in the users pocket or on a key chain.

It is an object of the invention to provide a pencil sharpener which is small and compact and which is easily carried by the user.

Still another object of the invention is to provide a pencil sharpener, which is cheap and economical and easy to operate.

Another object of the invention is to provide a carpenters pencil sharpener wherein the opposite wide sides and the opposite narrow sides are sharpened progressively in a manually operated sharpener.

It is another object of the invention to provide a pencil sharpener for carpenters' pencils, which is small and compact and can be easily transported in the pocket of a worker in readiness for immediate use.

SUMMARY OF THE INVENTION

The objects of the invention are obtained by a pencil sharpener in which a base member has a cover member supported on the base member for movement between a first position in which flat cutting blades supported by the cover member are out of engagement with the pencil and a second position in which the blades are moved into engagement to cut opposed surfaces of the pencil which is held in a stationary position relative to the base member. The blades are arranged to converge relative to the axis of the pencil and are slightly curved to form outwardly concave cutting edges.

Resilient means maintain the cover member in its first position and yieldingly resist movement to the second or cutting position. The base member is provided with apertures to receive the carpenter's pencil so that one of the openings guides the pencil to a cutting position in which the wide part of the pencil is in contact with a support surface on the base member and a second position in which the narrow side of the pencil is in abutting relation with the support surface. The cover member is movable repeatedly between first and second positions to shave the end of the pencil with the cutting blades so that sharpening the pencil is attained in two stages, one for the opposed wide surfaces of the pencil and the other for the narrow opposed surfaces of the pencil. Provision is made for tilting the pencil in each of its sharpening positions to support the core or lead for accurate finishing of the paint of the pencil.

DETAILED DESCRIPTION OF THE PREFERRED EMBODIMENT

Figure 1:
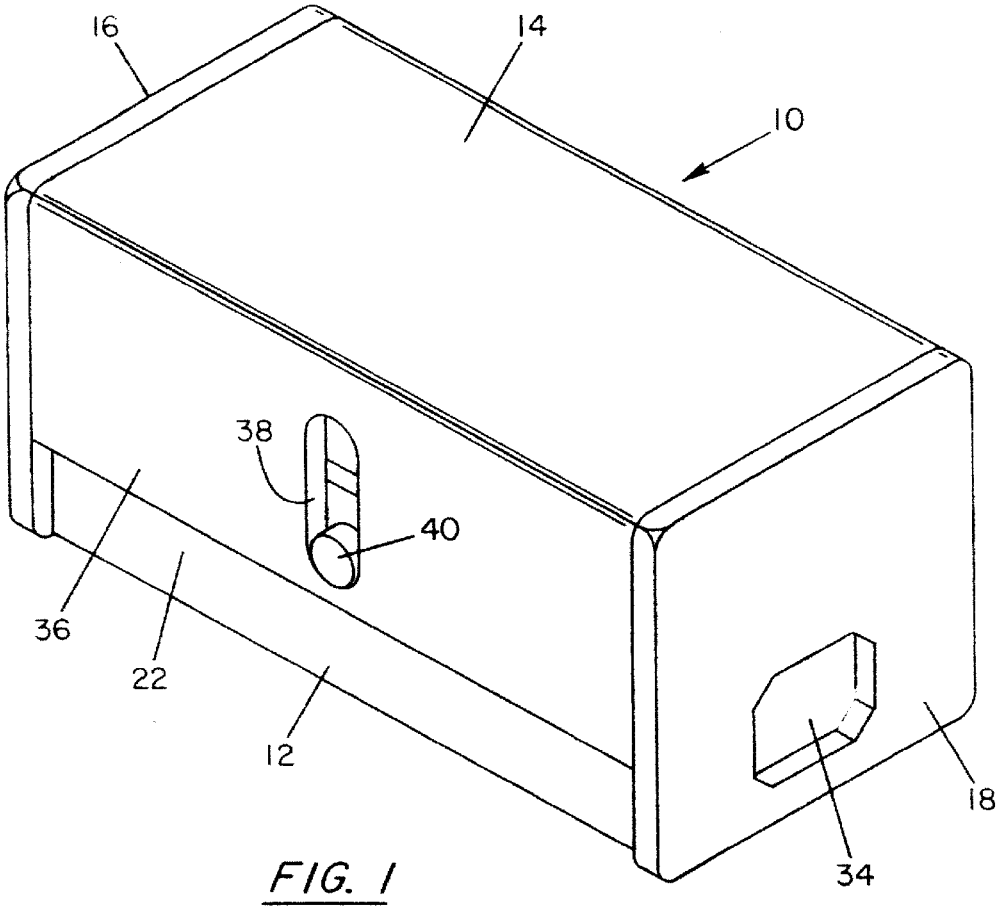
FIG. 1 is a perspective view of a preferred embodiment of the invention.

Referring to the drawings a pencil sharpener embodying the invention is designated generally at 10, incorporates a base member 12 and a cover member 14.

The base member 12 is made up of a pair of opposed end walls 16 and 18 joined with a bottom wall 20. The end walls 16 and 18 and bottom wall 20 are also joined together by opposed parallel sidewalls 22 to form a generally box-like structure.

Figure 2:
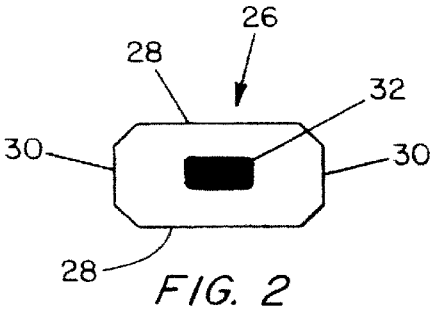
FIG. 2 is a cross-sectional view of a carpenters pencil of the type for which the pencil sharpener of the present invention is used.

The end wall 16 is provided with a pencil receiving opening 24 to permit insertion of a carpenter's pencil. Such a pencil is designated at 26 and an end view of an unsharpened pencil is shown in FIG. 2. Such pencils 26 are made of wood and have opposed wide, flat surfaces 28 and opposed narrow flat edge surfaces 30. The core 32 is of graphite and commonly referred to as a lead. When a pencil 26 is inserted in opening 24 it rests on its lower narrow edge 30 on the top surface of bottom wall 20 of base member 12. Similarly, the opposite end wall 18 has an opening 34 as seen in FIGS. 1 and 6 to receive a carpenters pencil 26 so that it is disposed with its lower, wide side 28 on the top surface of bottom wall 20 of base member 12.

Figure 4:
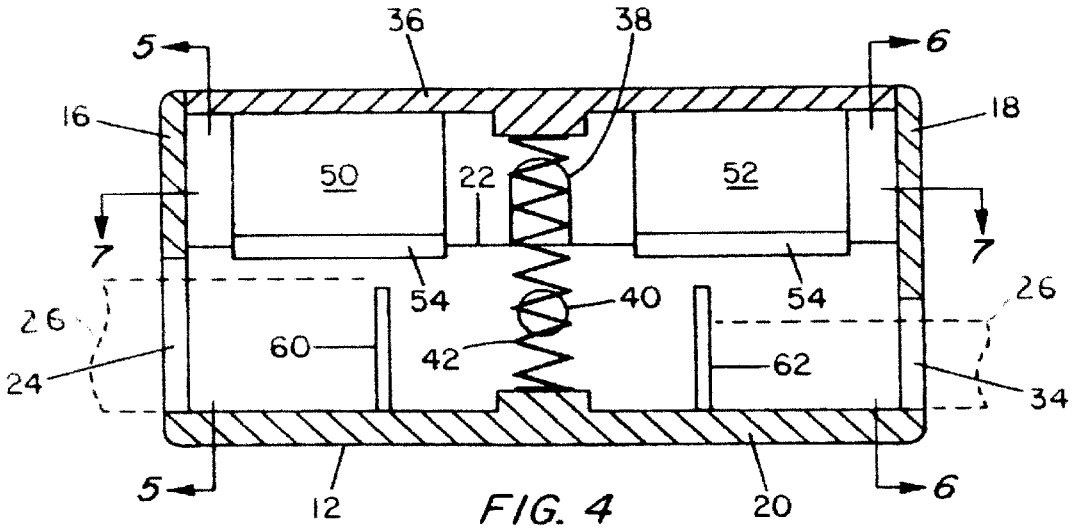
FIG. 4 is a longitudinal cross-sectional view of the pencil sharpener shown in FIG. 1.
Figure 5:
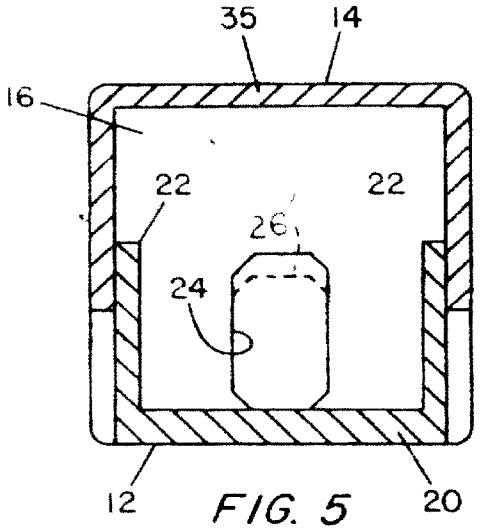
FIG. 5 is a cross-sectional view taken on line 5—5 in FIG. 4.
Figure 6:
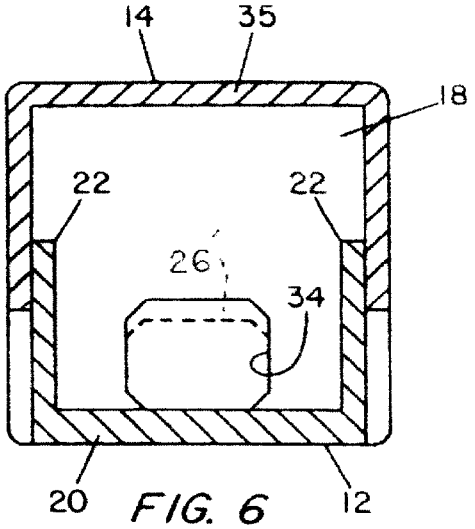
FIG. 6 is a cross-sectional view taken on line 6—6 in FIG. 4.

The cover 14 of the pencil sharpener 10 is generally U-shaped in cross-section and as viewed in FIGS. 5 and 6, has a top wall 35 and opposed parallel side walls 36. The spacing of the side walls 36 is slightly greater than the distance between the outside surfaces of the side walls 22 of the base member 12 so that the side walls 36 are free to move relative to the outside of the side walls 22. The side walls 36 are provided with slots 38 which receive guide pins 40 secured in fixed position to the side walls 22 of the base member 12. The slots 38 and pins 40 act to maintain the base and cover members 12 and 14 connected to each other and guide movement of these members relative to each other. The base member and cover member 14 are maintained in spaced apart relationship to each other by a coil spring 42 seen in FIGS. 4 and 7, having opposite ends acting between spring seats formed on the base member 12 and the cover member 14.

The cover member 14 supports first pair of cutting blades 50 adjacent the end wall 16 of the base member 12 and a second pair of cutting blades 52 which are adjacent to and associated with the end wall 18 of the base member 12. The cutting blades 50 are disposed at an angle to each other so that the cutting edges 54 extend away from the wall 16 and converge relative to each other to cut opposed surfaces 28 a pencil is positioned in the opening 24. Similarly, cutting blades 52 converge toward each other as they extend away from the wall 18 to cut the opposed narrow edge surfaces 30 of carpenter pencil 26 when it is positioned with its end in the opening 34 seen in FIG. 6. The position of the pencil 26 is shown in broken line at 26 in FIGS. 4 through 7.

The cutting blades 50 and 52 are slightly curved to give the sharpened ends of the pencil 26 a slightly concave surface, which many users find preferable to flat surfaces. It should be understood, however, that flat blades can be used.

The blades 50 and 52 may be supported in any conventional manner relative to the cover member 14 but preferably by it being embedded in the plastic material from which the cover member 14 is made. The base member 12 also is made of the same plastic material.

In use, the end of a carpenters pencil 26 is placed in a selected one of the openings 24 or 34 and the pencil sharpener 10 is squeezed to move the base member 12 and cover member 14 relative to each other against the resistance of spring 42. This brings the cutting blades 50 or 52 into cutting engagement with the pencil 26 to cut away a layer of wood material from the end surface of the pencil 26.

Figure 3:
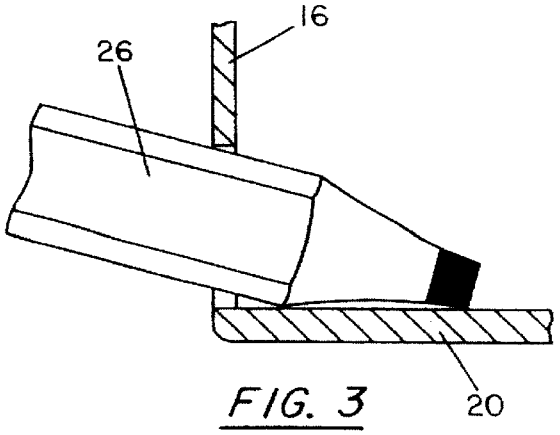
FIG. 3 is an enlarged view of a portion of a carpenter's pencil in one of its positions during sharpening.
Figure 7:
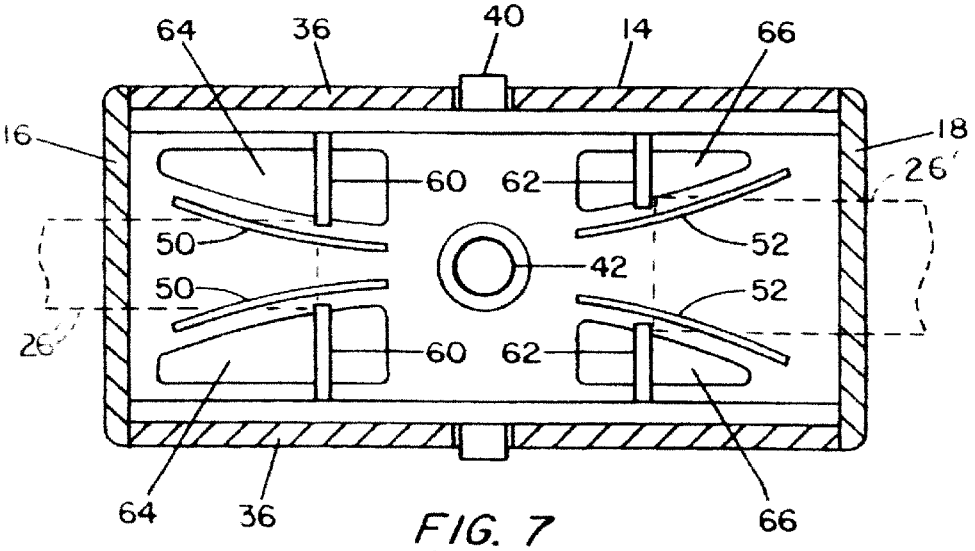
FIG. 7 is a top cross-sectional view taken on line 7—7 in FIG. 4.

As viewed in FIGS. 4 and 7 pairs of stops 60 and 62 can be molded integrally with the base member 12 to protrude inwardly from the side walls 22 into close proximity with the respective blades 50 and 52. The stops 60 and 62 act to limit the initial position of an unsharpened pencil 26 so that the thickness of the initial cut is a minimum. Repeated pressing of the base 12 and cover 14 together shaves layers of the wood covering to permit advance of the pencil 26 inwardly to expose the pencil core 32. Assuming that a new unsharpened pencil 26 is placed in opening 34 in wall 18 first, the opposite sides 30 of the pencil 26 will be cut at an angle to expose the core 32. Thereafter, the pencil can be placed in opening 24 in the opposite end wall 16 and after the sharpener has been repeatedly activated, the pencil core 32 will be reached. At this point the pencil 26 can be tilted as shown in FIG. 3 so that a previously cut pencil end rests against the top surface of the bottom wall 20. Such tilting is permitted because the vertical extent of both the openings 24 and 38 is slightly larger than an actual pencil as best seen in FIGS. 5 and 6.

After a pencil has been sharpened the first time, the pencil can be disposed at an angle in either opening 24 or 34 such tilting supports the core 32 against the upper surface of the bottom wall 20 which acts as an anvil and may be of assistance to support the core 32, particularly if it is made of soft material.

As mentioned previously, after sharpening of the pencil 26 utilizing both the openings 24 and 34, pencil 26 has a tapered end in which the surfaces are slightly concave.

The shavings, which result from sharpening of a pencil, are free to fall through openings 64 and 66 seen in FIG. 7 formed in the bottom wall 20 of base 12. Openings 64 are disposed outwardly from the blades 50 and openings 66 are outwardly of blades 52 leaving the top surface of bottom wall 20 between the blades and between the openings 60 to support the surface of a pencil during the cutting operation.

A pencil sharpener for sharpening carpenter's pencils or the type having a generally oblong or rectilinear cross-section has been provided by which such pencils can be mechanically sharpened accurately in a minimum amount of time and without the need to use pen knifes or sand paper. Moreover, the point formed with the sharpener gives a slightly concave contour to opposed edges which more closely approximates the type of surface that can be obtained by time consuming manual sharpening to give a fine point to the exposed lead or core repeatedly and uniformly. The sharpener is compact and easily transported on the person of the user.

I claim:

1. A pencil sharpener for pencils having opposed wide flat surfaces and opposed narrow edged surfaces, the combination comprising:

a base member, a cover member supported on said base member for movement between first and second positions, resilient means urging said cover member to a first position and yieldingly resisting movement to said second position, first and second cutting means supported on said cover member for movement therewith, first and second guide stations formed on said base member for holding a pencil in a selected one of two cutting positions, a first of said cutting positions being with one of said wide flat surfaces abutting said base member and the end of said cutting positions being with said narrow edge surface abutting said base member, said cover member being movable repeatedly between said first and second positions to engage and disengage said first cutting means with a pencil when the latter is in said first guide station, said cover member being moveable between first and second positions to engage and disengage said second cutting means with a pencil when the latter is in said second guide station.

2. A pencil sharpener in claim 1 and further comprising stop means disposed in proximity to said cutting means for engaging the end of a pencil located in one of said first and second guide station to limit the axial position of said pencil and the amount of material cut from the end thereof.

3. The pencil sharpener of claim 2 wherein stop means are a first and second pair of tabs associated with said first and second cutting means.

4. The pencil sharpener of claim 2 wherein said stop means are molded integrally with said base member.

5. The pencil sharpener of claim 1 wherein said first and second cutting means are each a pair of elongated blades.

6. The pencil sharpener of claim 5 wherein each pair of blades converge toward each other.

7. The pencil sharpener of claim 6 wherein said blades are curved to form a concave surface facing outwardly.

8. The pencil sharpener of claim 1 wherein said cover member forms vertically disposed slots and wherein a pin extends from a side of said base member, said pin being disposed in said slot for guiding movement of said cover member during movement relative to said base member.

9. The pencil sharpener of claim 1 wherein said base member forms openings in the bottom of said base member for discharging shavings from the pencil.

10. The pencil sharpener of claim 9 wherein each of said openings is disposed adjacent to and at one side of each of said blades.

11. The pencil sharpener of claim 1 wherein said first and second guide stations include an opening formed by a wall in said base member.

12. The pencil sharpener of claim 11 wherein said opening of said first guide station receives a pencil with said wide flat surfaces extending generally horizontally and said opening of said second guide station receives a pencil with said wide flat surfaces extending vertically.

13. The pencil sharpener of claim 12 wherein each of said openings associated with said first and second guide means are enlarged vertically to allow tilting of a pencil relative to said base member to support the end of said pencil during cutting.

14. A pencil sharpener for pencils of the type having a cross-section with opposed wide and narrow surfaces, the combination comprising:

a base member having a bottom wall and a pair of side walls;

a cover member supported for sliding movement between said walls and toward and away from said bottom wall between first and second positions;

a pair of pencil guide stations being formed on said base member, one of said stations holding a pencil with said wide flat surfaces abutting said base member and the other of said guide stations holding a pencil with a narrow flat surface abutting said base member;

first and second pairs of cutting blades supported on said cover member for movement therewith toward and away from said pair of guide stations on said base member, said pairs of cutting blades each converging toward each other; and said cover member being movable repeatedly between said first and second positions to bring said cutting blades into cutting engagement with said pencil disposed in a selected one of said guide stations to form opposed converging surfaces on said pencil.

15. The combination of claim 14 wherein said cutting blades are curved longitudinally to form concave surfaces by the opposed cut surfaces of a pencil have concave surfaces.

16. The pencil sharpener of claim 15 where stop members are formed integrally with said base member to extend toward each of said blade members, said stop members engaging the surface of an end of a pencil to limit axial movement relative to said blades.

17. The pencil sharpener of claim 14 wherein said guide stations each include an opening formed in a wail of said base member, said opening is conforming generally to the cross-section of said pencil to permit sliding movement.

18. The pencil sharpener of claim 17 wherein said openings are each enlarged vertically to permit tilting movement of a pencil in either of said guide stations.

* * * * *